US006952940B2

(12) United States Patent
Molzer et al.

(10) Patent No.: US 6,952,940 B2
(45) Date of Patent: Oct. 11, 2005

(54) DOUBLE LOCK T-HANDLE ASSEMBLY

(75) Inventors: Klaus Molzer, Nassjo (SE); Frederick Molzer, Nassjo (SE)

(73) Assignee: Allegis Corporation, Minneapolis, MN (US)

( * ) Notice: Subject to any disclaimer, the term of this patent is extended or adjusted under 35 U.S.C. 154(b) by 0 days.

(21) Appl. No.: 10/388,373

(22) Filed: Mar. 13, 2003

(65) Prior Publication Data

US 2004/0007031 A1 Jan. 15, 2004

Related U.S. Application Data

(63) Continuation-in-part of application No. 10/014,841, filed on Oct. 22, 2001, now Pat. No. 6,532,778.
(60) Provisional application No. 60/242,591, filed on Oct. 23, 2000.

(51) Int. Cl.[7] ..... E05B 13/10
(52) U.S. Cl. ..... 70/210; 70/208; 70/212
(58) Field of Search ..... 70/208, 203, 212, 70/210

(56) References Cited

U.S. PATENT DOCUMENTS

| | | | | |
|---|---|---|---|---|
| 958,815 | A | 5/1910 | Markham | |
| 1,534,584 | A | 4/1925 | Fredrick | |
| 1,716,536 | A | 6/1929 | Sieben | |
| 1,720,304 | A | 7/1929 | Toneray | |
| 1,812,334 | A | 6/1931 | Glockler | |
| 1,995,338 | A | 3/1935 | Andrews | |
| 2,034,746 | A | 3/1936 | Ciak et al. | |
| 2,160,611 | A | 5/1939 | Alexander | 292/348 |
| 2,219,626 | A | 10/1940 | Johnson | 74/535 |
| 2,459,920 | A | 1/1949 | Clark | 70/223 |
| 2,473,937 | A | 6/1949 | Cameron | 70/348 |
| 2,701,735 | A | 2/1955 | Segal | 292/348 |
| 2,707,121 | A | 4/1955 | Behnke | 292/228 |
| 2,844,020 | A | 7/1958 | Chimm et al. | |
| 2,851,871 | A | 9/1958 | Newell | 70/150 |
| 2,859,430 | A | 11/1958 | O'Callaghan | |
| 2,949,328 | A | 8/1960 | Kaiser | 292/207 |
| 3,096,114 | A | 7/1963 | Trammell, Jr. | 292/336.3 |
| 3,159,994 | A | 12/1964 | Schulz | 70/146 |
| 3,652,112 | A | 3/1972 | Panelli | 292/210 |
| 3,871,198 | A | 3/1975 | Miller | |
| 3,899,204 | A | 8/1975 | Ulrich | 292/336.3 |
| 4,031,730 | A | 6/1977 | Kern | 70/419 |
| 4,057,003 | A | 11/1977 | Atchisson | 89/138 |
| 4,099,593 | A | 7/1978 | Schultz | 180/114 |
| 4,216,985 | A | 8/1980 | Sorensen | 292/336.3 |
| 4,229,956 | A | * 10/1980 | Thorburn | 70/129 |
| 4,237,710 | A | 12/1980 | Cardozo | 70/108 |
| D271,562 | S | 11/1983 | Weinerman | |
| 4,470,277 | A | 9/1984 | Uyeda | 70/118 |
| 4,502,720 | A | 3/1985 | Fayerman et al. | 292/348 |
| 4,550,581 | A | 11/1985 | Best et al. | |
| 4,583,775 | A | 4/1986 | Bisbing | 292/64 |
| 4,623,178 | A | 11/1986 | Geringer et al. | 292/173 |
| 4,667,994 | A | * 5/1987 | Foshee | 292/358 |
| 4,706,478 | A | 11/1987 | Swan et al. | |
| 4,732,418 | A | 3/1988 | Crown et al. | 292/207 |
| 4,763,935 | A | 8/1988 | Bisbing | 292/66 |
| 4,827,614 | A | 5/1989 | Mitchell | 30/151 |
| 4,941,336 | A | 7/1990 | Steckler | 70/365 |
| 4,979,767 | A | 12/1990 | Lin | 292/336.3 |

(Continued)

*Primary Examiner*—John B. Walsh
(74) *Attorney, Agent, or Firm*—Vidas, Arrett & Steinkraus, P.A.

(57) ABSTRACT

A double lock T-handle is disclosed having a tray which includes an inwardly dished handle receiving area, a second recessed handle receiving region, and a recessed padlock receiving depression. The tray further includes a lock cylinder casing having a locking cylinder and a shaft cylinder casing having a shaft. The lock cylinder functions as a first lock and a padlock functions as a second lock for the double lock T-handle. The T-handle includes a locking shoulder and a fracturable throat section which deters forced breakage of the T-handle and undesirable opening of a locked door.

20 Claims, 9 Drawing Sheets

U.S. PATENT DOCUMENTS 4,989,907 A * 2/1991 Edmonds et al. ..... 292/223
5,015,019 A 5/1991 Razdolsky
5,172,944 A 12/1992 Munich et al. ..... 292/39
5,184,853 A 2/1993 Whatley ..... 292/205
5,236,234 A 8/1993 Norman ..... 292/201
5,259,091 A 11/1993 Mordick ..... 16/262
D343,347 S 1/1994 Lau et al. ..... D8/301
5,292,189 A 3/1994 Lau et al. ..... 312/265.3
5,299,597 A 4/1994 Fort et al. ..... 137/385
5,301,389 A * 4/1994 Engel et al. ..... 16/422
5,307,653 A * 5/1994 Davis ..... 70/56
5,339,659 A 8/1994 Guzzinati ..... 70/120
5,390,517 A 2/1995 Ymada ..... 70/210
5,408,853 A 4/1995 Yamada ..... 70/210
D360,345 S 7/1995 Swan et al. ..... D8/308
5,469,725 A 11/1995 Yamada ..... 70/208
5,474,339 A 12/1995 Johnson ..... 292/216
5,481,889 A 1/1996 Richard et al. ..... 70/118
5,509,700 A * 4/1996 Kennedy, Jr. ..... 292/3
5,509,703 A 4/1996 Lau et al. ..... 292/1
5,520,427 A 5/1996 Mader ..... 292/336.3
5,526,660 A 6/1996 Bennett et al. ..... 70/208
D371,300 S 7/1996 Mordick ..... D8/343
5,566,992 A 10/1996 Anderson et al. ..... 292/241
5,577,782 A 11/1996 Johnson et al. ..... 292/216
5,582,042 A 12/1996 Mordick ..... 70/14
5,582,443 A 12/1996 Finkelstein et al. ..... 292/202
5,584,515 A 12/1996 Silye ..... 292/201
5,595,408 A 1/1997 Jeche ..... 292/37
5,620,290 A 4/1997 Homfeldt et al. ..... 411/533
5,621,251 A 4/1997 Yamazaki ..... 307/10.2
5,630,632 A 5/1997 Swan ..... 292/240
5,632,070 A 5/1997 Wakabayashi ..... 24/419
5,634,357 A * 6/1997 Nutter et al. ..... 70/210
5,642,909 A 7/1997 Swan et al. ..... 292/39
5,664,448 A 9/1997 Swan et al. ..... 70/224
5,666,695 A 9/1997 Jegers et al. ..... 16/381
D385,768 S 11/1997 Nutter et al. ..... D8/308
5,683,005 A 11/1997 Mordick ..... 220/3.7
5,700,044 A 12/1997 Wartian ..... 292/336.3
5,704,100 A 1/1998 Swan ..... 24/656
D391,143 S 2/1998 Jancsek ..... D8/338
5,722,121 A 3/1998 Lau et al. ..... 16/381
5,732,575 A * 3/1998 Kaveney ..... 70/2
D396,397 S 7/1998 Swan ..... D8/331
5,775,145 A 7/1998 Kasper ..... 70/367
5,803,655 A 9/1998 Furuya ..... 403/398
5,806,351 A 9/1998 Learnahan ..... 70/56
D400,076 S 10/1998 Jancsek et al. ..... D8/331
5,862,690 A 1/1999 Jancek ..... 70/224
5,879,035 A 3/1999 Jancsek et al. ..... 292/202
5,899,508 A 5/1999 Cetnar et al. ..... 292/216
D411,433 S 6/1999 Swan et al. ..... D8/306
5,927,014 A 7/1999 Goldenberg ..... 49/182
6,019,402 A 2/2000 Arabia, Jr. et al. ..... 292/216
6,039,363 A * 3/2000 Sugimura et al. ..... 292/202
6,045,168 A 4/2000 Johnson et al. ..... 292/216
6,053,543 A 4/2000 Arabia, Jr. et al. ..... 292/201
6,067,826 A 5/2000 Holloway et al. ..... 70/278.3
6,068,308 A * 5/2000 Molzer ..... 292/336.3
6,101,856 A 8/2000 Pelletier et al. ..... 70/472
6,131,967 A 10/2000 Kondo et al. ..... 292/201
6,145,354 A 11/2000 Kondo et al. ..... 70/279.1
6,257,154 B1 7/2001 Kasper ..... 109/73
6,263,712 B1 * 7/2001 Ramsauer ..... 70/208
6,293,130 B1 * 9/2001 Ramsauer ..... 70/2
6,318,770 B1 11/2001 Molzer ..... 292/336.3
6,354,119 B1 3/2002 Molzer ..... 70/210
6,427,501 B2 * 8/2002 Ramsauer ..... 70/208
6,474,119 B1 11/2002 Halvorson et al. ..... 70/208
6,532,778 B2 3/2003 Molzer et al.

* cited by examiner

DOUBLE LOCK T-HANDLE ASSEMBLY

CROSS REFERENCE TO RELATED APPLICATIONS

This patent application relates to a double lock T-handle assembly and is a continuation-in-part application which is based upon U.S. application Ser. No. 10/014,841 filed Oct. 2, 2001, now U.S. Pat No. 6,532,778, which in turn claims priority to U.S. Provisional Patent Application Ser. No. 60/242,591 filed Oct. 23, 2000, the entire contents both of which are incorporated herein by reference in their entireties.

BACKGROUND

Latch assemblies with handles have been known. In the past, latch assemblies have been lockable through the use of an internal lock cylinder to prevent the undesirable rotation at the handle. Latch assemblies are frequently manipulated between a locked and/or an unlocked position. In general, the unlocked position is representative of the handle being rotated where the attached door may be opened with one hand. Generally, for a right handed individual the handle is rotated in a clockwise direction for opening of a door. Latches are generally formed of a single locking component. Frequently a need exists for added locking features such as the use of a padlock.

Secondary locks such as padlocks are frequently inadequate, absent, and/or difficult to incorporate into an existing latch assembly. A need exists for a double locking latch mechanism which is easily adaptable for varying applications. In the past, latching assemblies having handles have not included designated handle fracture locations to anticipate forced breakage. A need exists for a latch assembly having a handle having a designated fracture point which maintains a locking position following attempted forced breakage. A need also exists for a handle having a designated fracture point between the handle and the locking cylinder on the throat section of the handle where the handle remains locked following breakage to prevent undesired access into a compartment.

GENERAL DESCRIPTION OF THE INVENTION

An advantage of the invention is to provide a double lock T-handle of relatively simple and inexpensive design, construction, and operation which fulfills the intended purpose without risk of injury to persons and/or damage to property.

Another advantage of the double lock T-handle is to provide a latching assembly requiring at least two operations prior to the rotation of the handle for separation of a roller cam from a keeper as integral to a structure. The operations required prior to the unlatching of the double lock T-handle include the disengagement of a locking pin from a locking aperture as integral to the Handle through rotation of a locking cylinder. The unlocked handle may then be elevated into a first operational position prior to rotation in either a clockwise or counterclockwise direction. The rotation of the T-handle separates the roller cam from the keeper as integral to a structure to permit movement of a door relative to the structure. Additional steps include the disengagement of a padlock from a padlock hasp, and the retraction of the padlock hasp into the tray or frame to permit elevation of the T-handle to the first elevated operational position.

Still another advantage of the invention is to provide a double lock T-handle having a shaft integral to a handle where the shaft is engaged to a shaft casing having opposite rotational restriction surfaces which, in turn, are adapted for contact with mating rotational restriction surfaces of a collar to restrict either the clockwise and/or counterclockwise rotation of the handle.

Still another advantage of the double lock T-handle is to provide a shaft casing having a protruding surface defining first and second rotational restriction surfaces, where the first and second rotational restriction surfaces are adapted for insertion into a slot integral to a collar as engaged to the handle and shaft, during the manipulation of the handle into the non-operational and/or locking position.

Still another advantage of the present invention is the provision of a double lock T-handle having a padlock hasp which is retractable into a tray following removal of a padlock from the padlock hasp.

Still another advantage of the present invention is the provision of a double lock T-handle having a locking cylinder which may be manipulated by a key to rotate the locking cylinder having a cam which actuates a pin. The pin may be positioned in a slot or affixed to a pin bracket. The pin may be elevated from the pin bracket or casing through a pin slot or bore for insertion into the pin aperture within the handle to lock the handle in a non-operational position.

Still another advantage of the present invention is the positioning of the locking cylinder, padlock hasp, cam, pin casing or bracket, and locking pin individually or in combination within a back plate cover to prevent access to the identified features of the double lock T-handle during use.

Still another advantage of the present invention is the provision of angled ramps integral to the collar and/or cylinder casing, and proximate to the slot, which function to facilitate rotational manipulation of the handle during adverse environmental conditions.

Still another advantage of the present invention is the provision of a plurality of channels regularly spaced about the distal end of the shaft cylinder casing to reduce surface contact between the shaft cylinder casing and the interior of the collar or shaft casing.

Still another advantage of the present invention is the provision of rotational handle restricters/stops integral to the collar or shaft casing to prevent either counterclockwise or clockwise rotation of the handle relative to the tray.

Still another advantage of the present invention is the provision of an adjustable cam to facilitate the use of the double lock T-handle on a variety of doors as manufactured by different entities.

Still another advantage of the present invention is the provision of an integral face plate omitting mounting holes and/or apertures, where studs are secured to the rear surface of the face plate for mounting within a structure.

Still another advantage of the present invention is the provision of plugs to replace and/or block the use of the padlock hasp.

Still another advantage of the present invention is the provision of a plug to replace the lock cylinder.

DETAILED DESCRIPTION OF THE INVENTION

Figure 2:
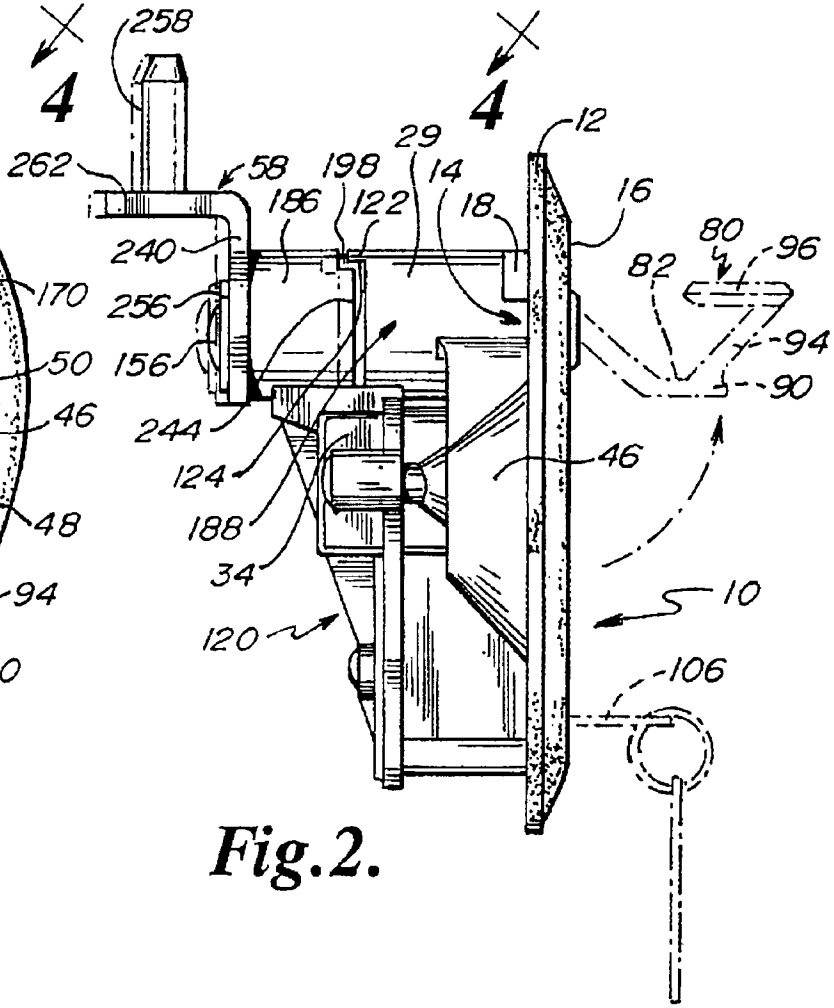
FIG. 2 is a side partial phantom line view of the double lock T-handle.
Figure 1:
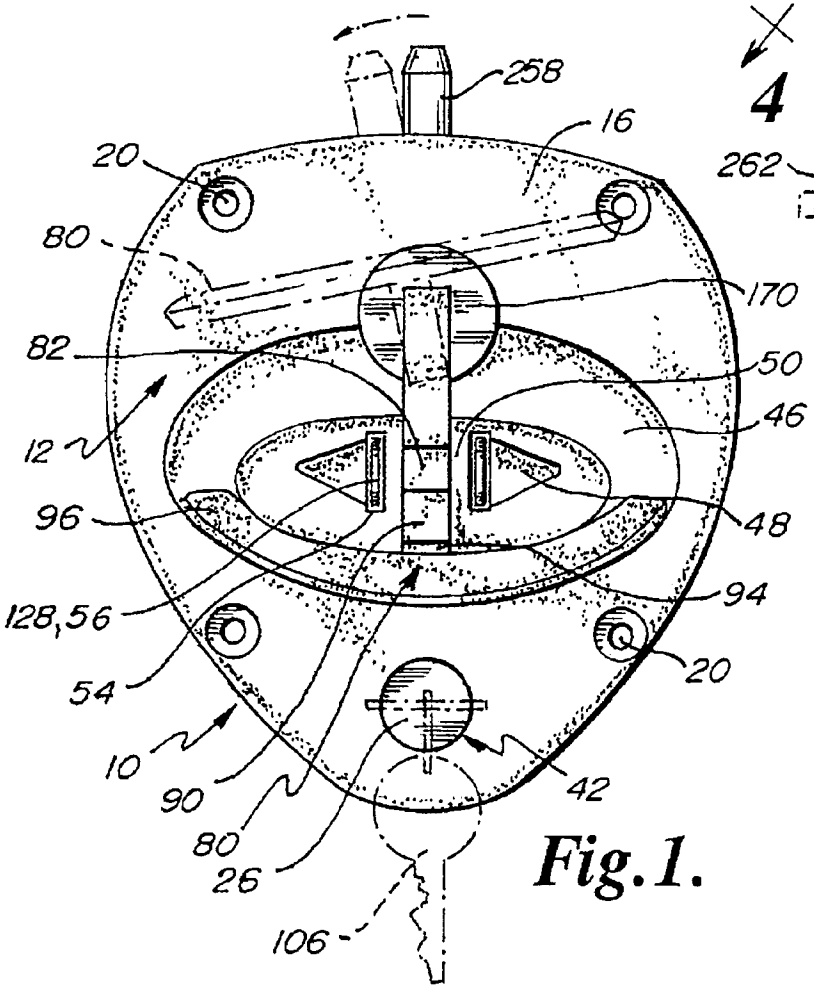
FIG. 1 is a front partial phantom line view of the double lock T-handle.
Figure 3:
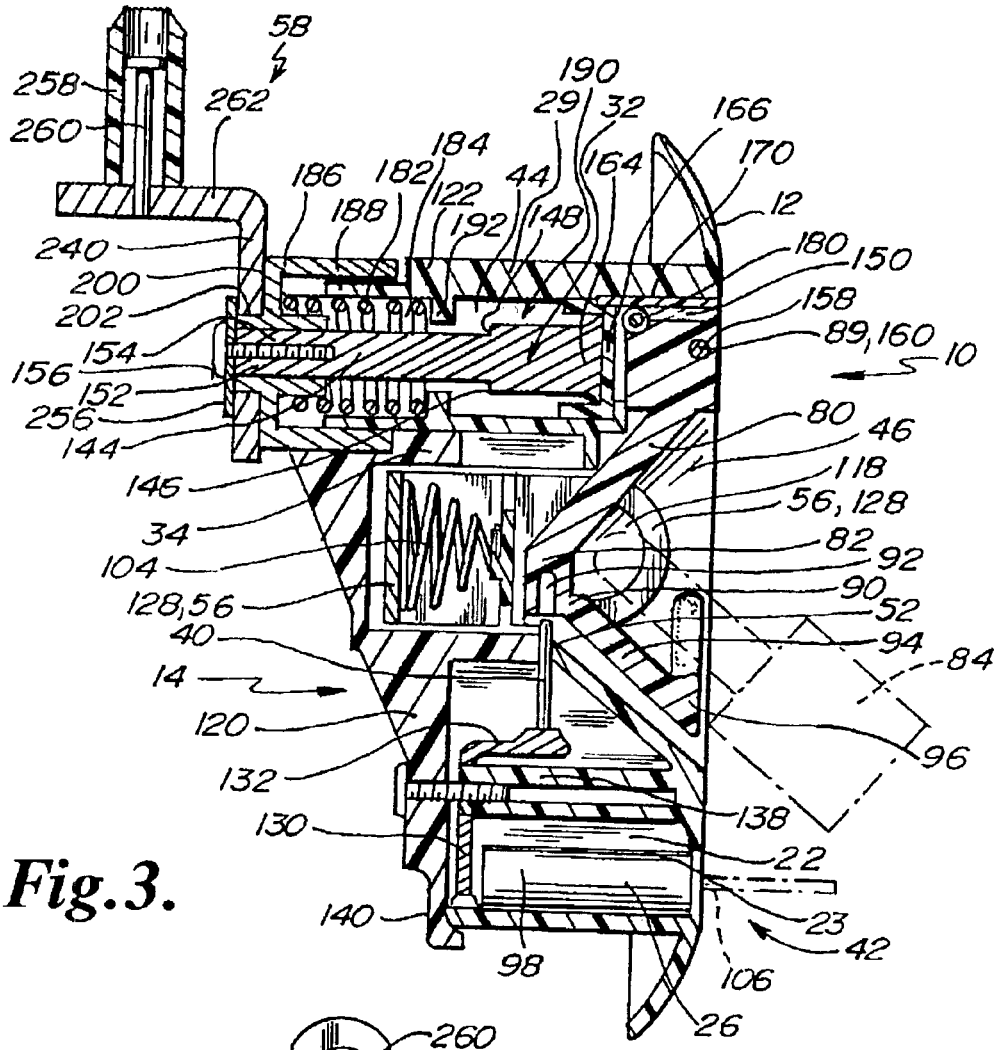
FIG. 3 is a cross-sectional side view of the double lock T-handle taken along the line of 4—4 of FIG. 2.
Figure 4:
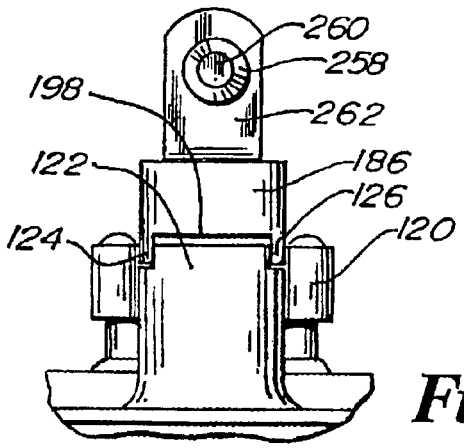
FIG. 4 is a partial top view of the shaft casing and roller cam of the double lock T-handle.
Figure 4A:
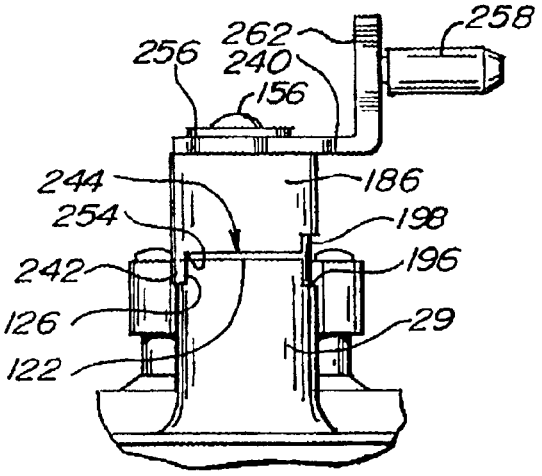
FIG. 4A is a side view of the shaft casing and roller cam of the double lock T-handle.
Figure 5:
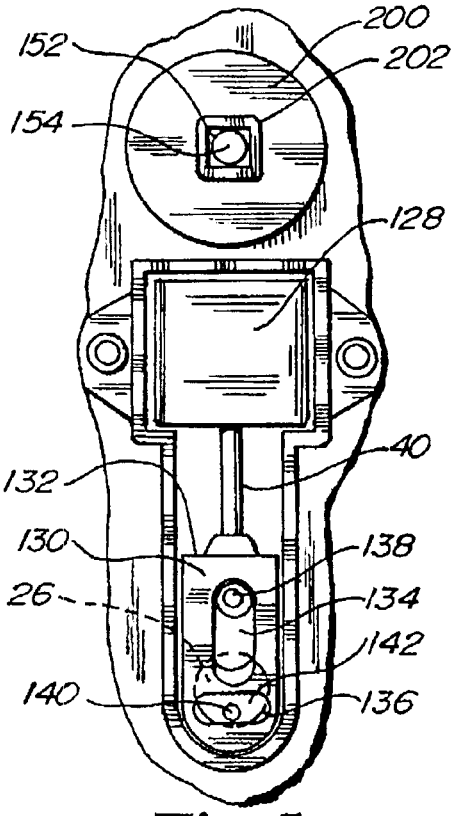
FIG. 5 is an alternative detail rear view of the first locking mechanism.
Figure 5A:
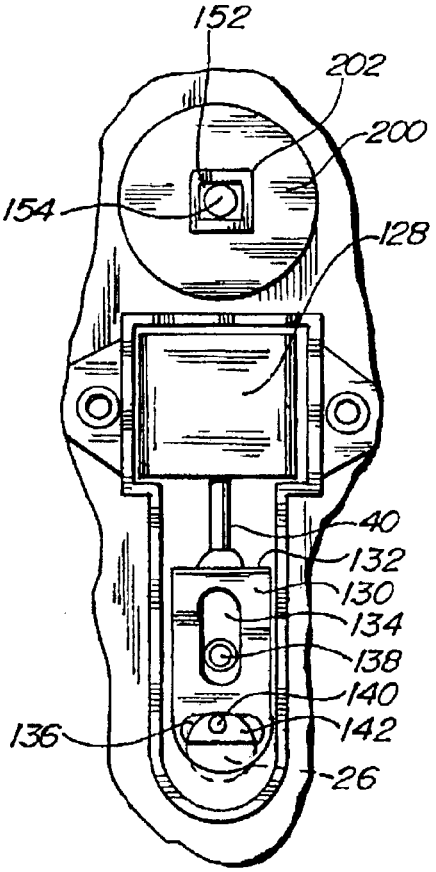
FIG. 5A is an alternative detail rear view of the first locking mechanism.
Figure 6:
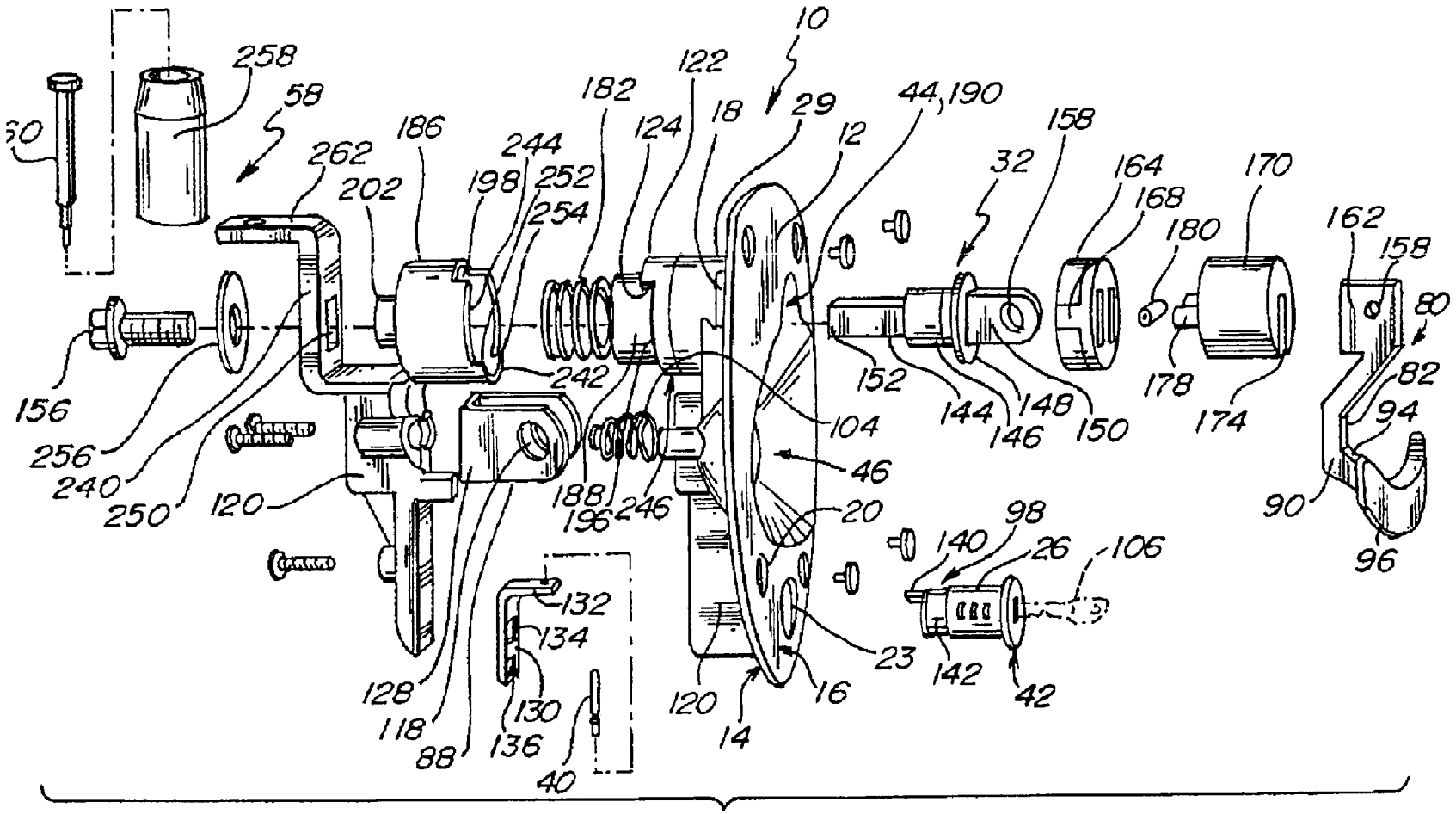
FIG. 6 is an exploded view of the double lock T-handle.

In general, the double lock T-handle assembly is indicated by the numeral 10. The double lock T-handle assembly 10 is preferably formed of a tray 12. The tray 12, may be stamped, die-cast, or formed of molded plastic, fiberglass, metal, stainless steel, and/or a desired type of composite material. The tray 12 is preferably adapted for positioning within an opening in a door such as a semi tractor access door. The tray 12 has a back side 14 and a front side 16.

The back side 14 preferably has a plurality of index pins 18 which function to prevent rotation of the base 12 relative to the door of a vehicle and/or other structure. The tray 12 also preferably includes a plurality of affixation apertures 20 which are adapted to receivingly engage fasteners such as screws to securely position the tray 12 relative to a door of a vehicle. The affixation apertures 20 are preferably regularly spaced about the circumference of the tray 12.

The back side 14 may be entirely encased within an enclosure or a back plate cover 120. Alternatively, the back side 14 may include a rearwardly extending lock cylinder casing 22. The rearwardly extending lock cylinder casing 22 is preferably adapted for positioning within the interior of the door of a vehicle and is further adapted to support and receivingly hold a lock cylinder 26. Opposite to the lock cylinder casing 22 is preferably a rearwardly extending shaft cylinder casing 28 having a second stop 30. The second stop 30 preferably functions to position the shaft 32 and shaft cylinder casing 28 in a normal position for transition from an operational to a non-operational locking position of the T-handle 80. The shaft cylinder casing 28 is preferably adapted for positioning and structural support of the shaft 32. The lock cylinder casing 22 preferably has a centrally positioned bore 23 adapted for receiving engagement of the lock cylinder 26.

Adjacent to the shaft cylinder casing 28 may be a padlock bracket housing 34 which may be removably and/or releasably secured to the back side 14. A suitable fastener such as a bolt may be utilized to secure the padlock bracket housing 34 to the backside 14. The lock cylinder casing 22 may be separated from the padlock bracket housing 34 and the shaft cylinder casing 28.

A pin aperture support 36 may extend from the padlock bracket housing 34 towards the lock cylinder casing 22. The pin aperture support 36 may be separated from the lock cylinder casing 22. The pin aperture support 36 preferably has a normally extending aperture 38 which is adapted to slidably receive a pin 40 which functions as the first locking mechanism 42 for the double lock T-handle assembly 10.

The shaft cylinder casing 28 preferably includes a first bore 44 which is adapted to receive the shaft 32.

The front side 16 of the tray 12 includes an inwardly dished handle receiving area 46 which may be substantially oval in shape. Within the interior of the handle receiving area 46 is preferably located a first recessed padlock receiving depression 48 and a centrally located second recessed handle receiving region 50. The second recessed handle receiving region 50 preferably includes a pin ledge 52 which includes a pin aperture 38 as traversing the pin aperture support 36. In addition, the handle receiving area 46 preferably includes a pair of padlock hasp receiving slots 54 positioned adjacent and exterior to the second recessed handle receiving region 50 and proximate to the first recessed padlock receiving region 48. The padlock hasp receiving slots 54 are preferably adapted for the receipt and positioning of a padlock hasp 128.

The latching mechanism will generally be identified by the numeral 58. The latching mechanism 58 preferably includes the shaft 32 which is positioned in the shaft bore 44. A shaft casing 60 is preferably positioned for covering relationship over the shaft 32 and is adapted for coupling with the shaft cylinder casing 28. Within the interior of the shaft casing 60 and shaft cylinder casing 28 is preferably located a first spring 182. The shaft casing 60 preferably has a first end 64 having a first notch 66. The first notch 66 is preferably adapted for engagement to the second stop 30 of the shaft cylinder casing 28 preventing rotation of the T-handle 80. In this configuration the first spring 182 is compressed between the shaft casing 60 and the shaft cylinder casing 28.

The shaft casing 60 also preferably includes a second end 68 which is opposite to the first end 64. The second end 68 is adapted to hold an L-shaped bracket 70 having a roller cam 72. The roller cam 72 is adapted for engagement to a keeper which is integral to the frame of a door for closing and coupling of the latching mechanism 58 to the door during use of the double lock T-handle assembly 10.

The shaft 32 may include a coupling end 74 which may either be substantially solid having an aperture, and the coupling end 74 may be constructed for affixation to prongs 88 integral to the T-handle 80.

The latching mechanism 58 may be designed to rotate in either a clockwise or counter clockwise direction dependent upon operation by a right or left handed individual. Right and/or left handed rotation is available due to the existence of first position limiters where one of the first position limiters is located on opposite sides of the shaft cylinder casing 28. The positioning limiters are constructed to engage the second stop 30 on either side of the shaft cylinder casing 28. The existence of mirror image first positioning limiters on opposite sides of the shaft cylinder casing 28 enables simultaneous clockwise and/or counterclockwise rotation of the T-handle 80 relative to the shaft cylinder casing 28.

Interior to the first bore 44 may be located a friction reducing member 78 which may be formed of brass rollers, plates, and/or Teflon® material to facilitate the upward manipulation of the T-handle 80 into an operational position. The T-handle 80 may then be rotated in a normal radial clockwise or counter clockwise direction to alter the relative location of the first position limiters relative to the second stops 30 for latching or unlatching of the roller cam 72 from a keeper interior to a door.

A first spring 182 may be positioned within the interior of the shaft casing 60 for surrounding engagement of the shaft 32. The first spring 182 preferably compresses when the T-handle 80 is manipulated downwardly to the non-rotational position within the inwardly dished handle receiving area 46, which causes the shaft 32 and shaft casing 60 to be drawn into coupling engagement with the shaft cylinder casing 28. Release of the T-handle 80 permits expansion of the first spring 182 and repositioning of the shaft 32 rearwardly to a normal operational position where the T-handle 80 is aligned to the shaft 32 and the shaft casing 60 permitting separation of the shaft casing 60 from the shaft cylinder casing 28.

The T-handle 80 preferably includes a padlock receiving region 82 which is adapted for positioning within the second recessed handle receiving region 50. A padlock 84 is preferably adapted for positioning through each prong of the padlock hasp 128 over the padlock receiving region 82 of the T-handle 80. The T-handle 80 also preferably includes a knuckle end 86 which may be substantially solid having a pivot aperture or prongs 88. The knuckle end 86 is preferably adapted to engage the coupling end 74 of the shaft 32 for secure pivotal attachment thereto through the use of a pivot pin as placed through a pivot aperture. The padlock receiving region 82 preferably extends from the knuckle end 86. Opposite to the knuckle end 86 is a pin receiving shoulder 90 which includes a pin aperture 92. The pin aperture 92 is adapted for receiving engagement of the pin 40 during locking of the double lock T-handle assembly 10 in the non-operational position relative to the tray 12. Extending angularly outward from the pin receiving shoulder 90 is preferably a fracturable throat section 94 which terminates in a pair of grasping members 96 which may be accurate in shape. The grasping members 96 extend perpendicularly outward from the fracturable throat section 94 forming the T-shaped handle 80. The grasping members 96 are preferably constructed and arranged for flush positioning relative to the contour of the lower lip of the handle receiving area 46 of the tray 12.

The fracturable throat section 94 may include a reduced cross-sectional area. The implementation of a sharp impact or leverage upon the grasping members 96 which may occur when someone is attempting to pry open the T-handle 80 will result in the fracture of the fracturable throat section 94 at the location of the reduced cross-sectional area, inhibiting further movement of the pin receiving shoulder 90, curved padlock receiving region 82, and/or separated T-handle 80 from a depressed locked position.

A locking cylinder 26 is preferably adapted for positioning within the lock cylinder casing 22. The locking cylinder 26 may include a distal end 98 having an eccentric cam 100 releasably secured thereto. The eccentric cam 100 preferably includes a positioning ledge 102 which is adapted for placement adjacent and proximate to the lock cylinder casing 22. The eccentric cam 100 is preferably adapted to engage the pin 40 for slidable vertical positioning of the pin 40 within the pin aperture 38 as traversing the pin aperture support 36. A pin spring 110 is preferably located within the pin aperture support 36 to engage the pin 40 for continuous contact between the pin 40 and the eccentric cam 100 during use of the locking cylinder 26. The rotation of the locking cylinder 26 preferably causes the rotation of the eccentric cam 100 for rotation of the positioning ledge 102. The rotation of the locking cylinder 26 will terminate when the trailing edge of the positioning ledge 102 is adjacent to the pin 40. A key 106 preferably rotates the locking cylinder 26 for either vertical retraction and/or penetration of the pin 40 within the pin aperture 92 of the pin receiving shoulder 90. The positioning ledge 102 and the eccentric cam 100, which has a larger diameter than the locking cylinder casing 22, preferably prevents forward separation of the locking cylinder 26 from the bore 23. In addition, the locking cylinder 26 preferably has a lip which has a larger diameter dimension than the bore 23 to prevent undesirable rearward penetration within the bore 23.

A padlock hasp spring 104 is preferably positioned within the padlock bracket housing 34. The padlock hasp 128 may function independently between the left side and the right side, or the padlock hasp 128 may be formed of one piece construction. The padlock hasp spring 104 is preferably positioned between a hasp bridge and a positioning bridge. The padlock hasp 128 preferably includes two arms where each arm includes a padlock receiving aperture 118 which is constructed and arranged to receive and position a padlock 84 over the curved padlock receiving region 82 of the T-handle 80. In order to engage a padlock 84 to the padlock hasp 128, the padlock hasp arms are required to be manipulated or drawn forwardly and outwardly from the first recessed padlock receiving region 48. The forward manipulation of the padlock hasp arms from the first recessed padlock receiving region 48 preferably compresses the padlock hasp spring 104. The release of the padlock hasp 128 and the removal of a padlock 84 from the padlock receiving apertures 118 permits the padlock hasp arms to be retracted rearwardly and partially into the padlock bracket housing 34 by the expansion of the padlock hasp spring 104. The at rest position for the padlock hasp 128 is to be partially retracted into the padlock bracket housing 34 when a padlock 84 is not positioned through the padlock receiving apertures 118.

It should be noted that the T-handle 80, latching mechanism 58, padlock hasp 128, and the lock cylinder 26 may be engaged to the tray 12 by positioning through either the front side 16 or back side 14 for releasable affixation to the back side 14. The padlock 84 functions as the second locking mechanism for the double lock T-handle assembly 10 during use. The breakaway features of the T-handle 80 deter the opening and failure of the handle without prior manipulation of the lock cylinder 26.

Figure 7:
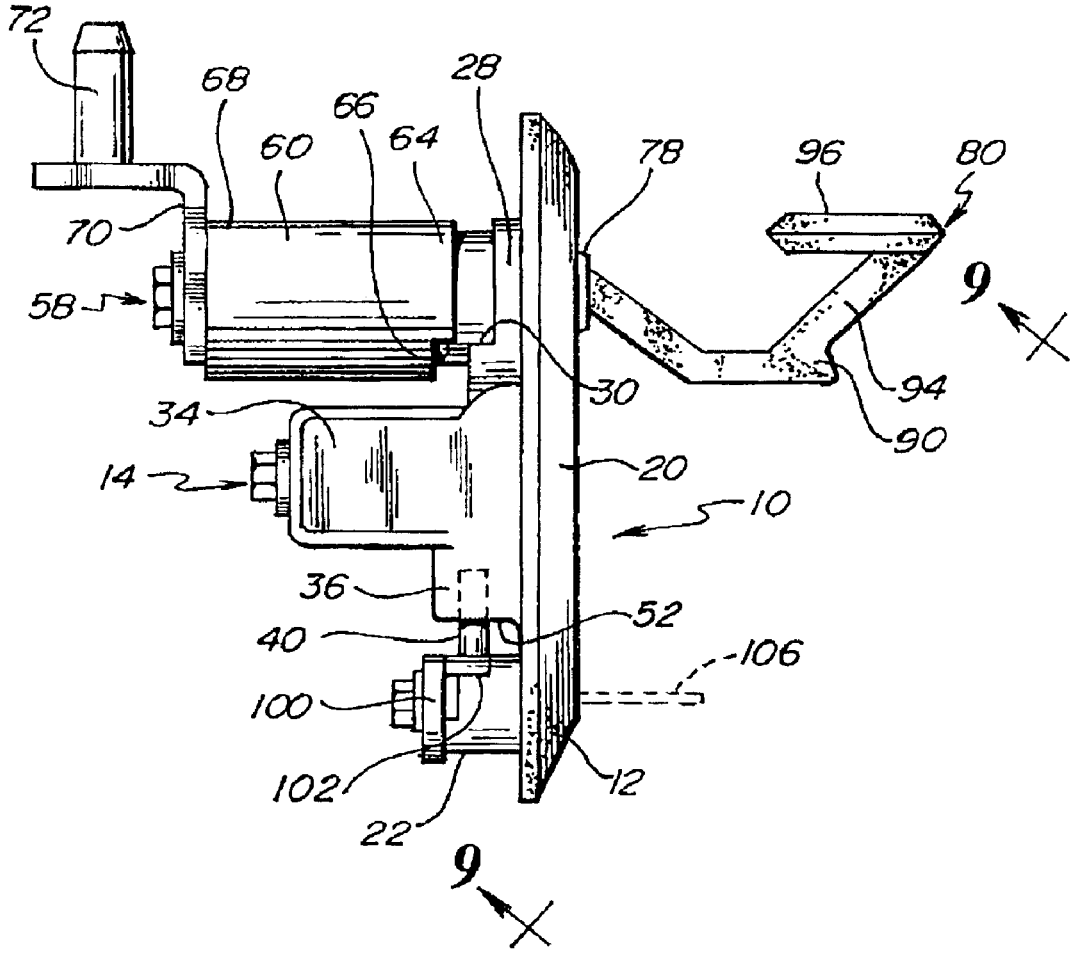
FIG. 7 is an alternative side view of the double lock T-handle.
Figure 8:
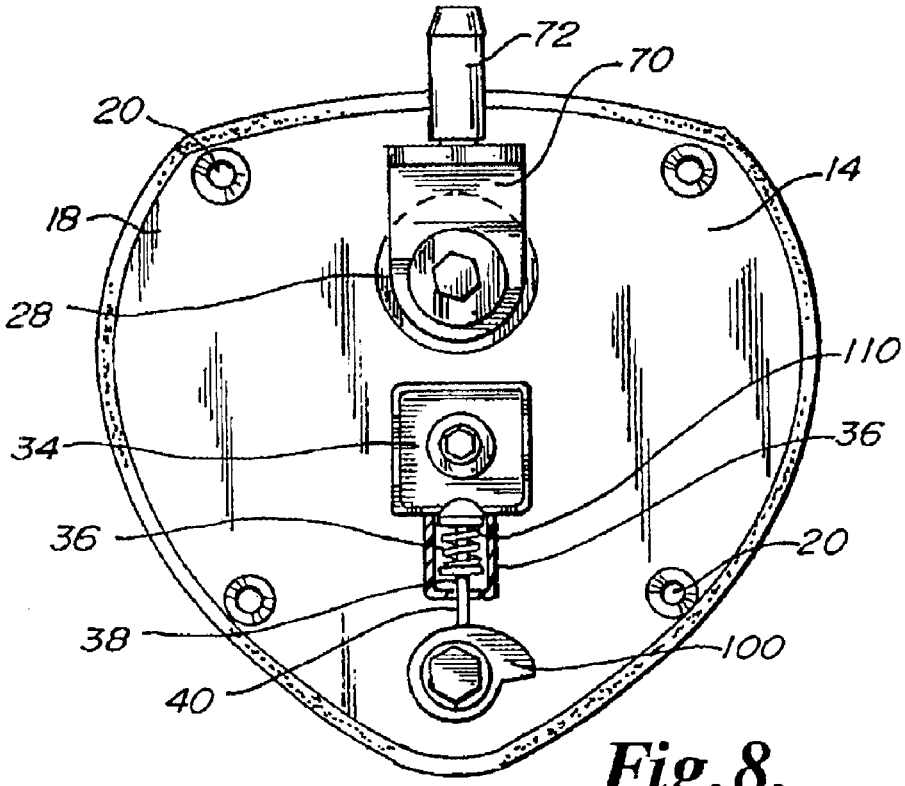
FIG. 8 is an alternative rear view of the double lock T-handle.
Figure 9:
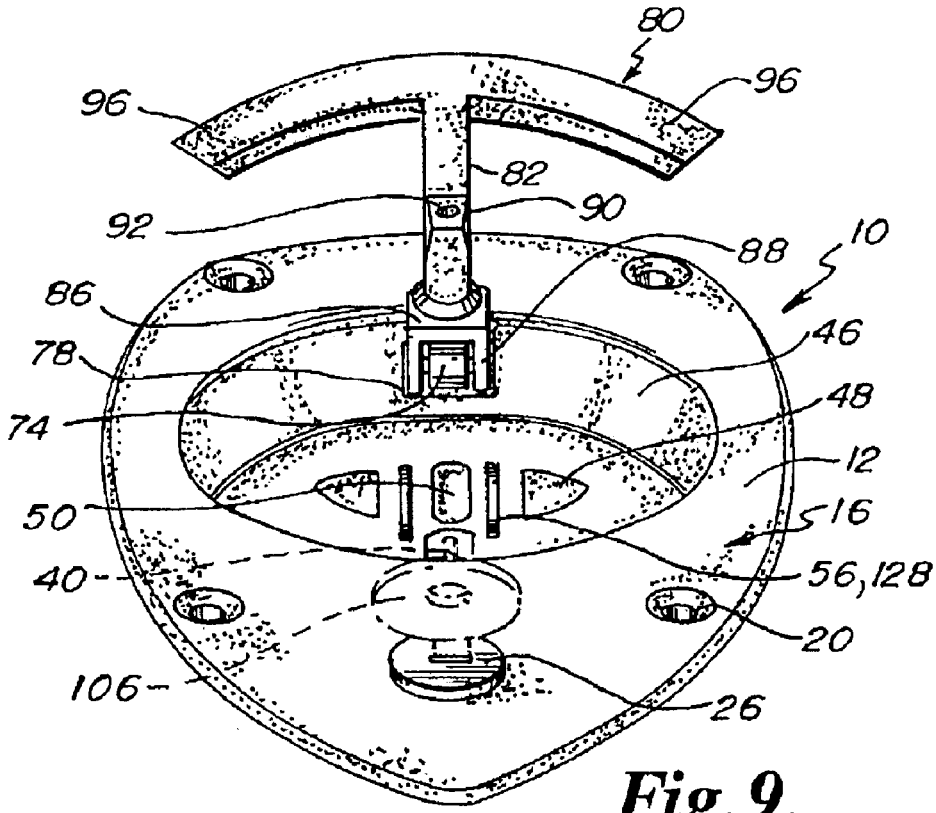
FIG. 9 is an alternative environmental view of the double lock T-handle taken along the line of 9—9 of FIG. 7.

The features of the shaft cylinder casing 28 and the shaft casing 60 are identical between FIGS. 7, 8, and 9, herein with the exception that the shaft casing in FIGS. 1 through 6, has a reduced longitudinal dimension and is therefore referred to as a collar 186. The shaft cylinder casing in FIGS. 1 through 6 is referred to by reference numeral 29. Both the collar 186 and the shaft casing 60 include the features of the rear wall 200, lug 202, L-shaped cam base 240, second protruding section 242, second intermediate sections 244, second notch 246, and sleeve 248. Likewise, the shaft cylinder casing 28 and the shaft cylinder casing 29 each include a distal end 188, first notch 198, pair of intermediate sections 196, and protruding section 122. The functionality and/or radial rotational engagement between the shaft cylinder casing 28 and the shaft casing 60 is the same as the rotational interaction between collar 186 and the shaft cylinder casing 29.

The protruding section 122 of the shaft cylinder casing 29 preferably includes a first positioning limiter 124 and a second positioning limiter 126. The shaft cylinder casing 29 is preferably adapted for positioning and structural support of the shaft 32.

Adjacent to the shaft cylinder casing 29 within the back plate cover 120 is preferably positioned the padlock hasp 128 which may be removably and/or releasably secured within the back plate cover 120. A suitable fastener such as a screw may be utilized to secure the back plate cover 120 to the backside 14 of the tray 12. The lock cylinder casing 22 may be positioned adjacent to the padlock hasp 128 within the back plate cover 120 and opposite to the shaft cylinder casing 29.

A pin support 36 is preferably positioned within the back plate cover 120 between the lock cylinder 26 and the padlock hasp 128. The pin support 36 is preferably separated from the lock cylinder casing 22. The pin support 36 preferably has a normally extending channel 39 which is adapted to slidably receive a pin 40 which functions as the first locking mechanism 42 for the double lock T-handle assembly 10. The pin 40 preferably extends upwardly from a pin bracket 130. The pin bracket 130 is generally L-shaped having a pin support section 132, a normally extending guide slot 143, and a traversly extending pin cam slot 136. The normally extending pin guide slot 134 is adapted for positioning over a guide 138 which enables sliding upward and downward positioning of the pin 40 and pin bracket 130 relative to the back cover plate 120.

The traversly extending pin cam slot 136 preferably receives a cam pin 140. The cam pin 140 is engaged to and extends outwardly from the cam 142 of the locking cylinder 26. Rotation of the locking cylinder 26 through the use of a key 106 in a clockwise direction laterally forces the cam pin 140 upwardly against the upper surface of the pin cam slot 136 to upwardly slide the pin bracket 130 past the guide 138 for elevation of the locking pin 40 for insertion into the pin aperture 92 of the T-handle 80, thereby locking the T-handle 80 in a second non-operational position relative to the tray 12. Rotation of the key 106 of the locking cylinder 26 in a counterclockwise direction laterally forces the cam pin 140 downwardly against the bottom surface of the pin cam slot 136 to downwardly slide the pin bracket 130 past the guide 138 for retraction of the pin 40 from the pin aperture 92 of the T-handle 80 for unlocking of the T-handle 80 relative to the tray 12.

The back plate cover 120 may be adapted for positioning within the interior of the door of a vehicle or structure and is further adapted to support and receivingly hold a lock cylinder housing 26. The shaft cylinder casing 29 preferably includes a first bore 44 which is adapted to receive the shaft 32.

The shaft 32 may be formed of a longitudinally extending square section 144, a cylindrical section 146, an intermediate ledge 148, and at least one, and preferably two, attachment prongs 150. Alternatively, the shaft 32 may be completely cylindrical and/or square. The distal end 152 of the longitudinally extending square section 144 preferably includes a threaded aperture 154 which is adapted for receiving engagement of a screw 156. Each of the attachment prongs 150 preferably includes an affixation aperture 158 which are constructed and arranged to receive a pivot pin 160 utilized to pivotally attach a handle shank 162 to the shaft 32.

During assembly the shaft 32 is preferably positioned within a shaft guide bracket 164. The shaft guide bracket 164 is generally cylindrical in shape having a centrally positioned, vertically extending barrier 166. To the exterior of the shaft guide bracket 164 is preferably located a pair of opposite guide slots 168. Initially, the shaft guide bracket 164 is manipulated past the affixation prongs 150 positioning the barrier 166 between the two affixation prongs 150. The shank 162 of the T-handle 80 may then be attached to the affixation prongs 150 through the placement of the pivot pin 160 within the affixation aperture 158. The T-handle 80 is thereby pivotally attached to the shaft 32. The shaft guide bracket 164 is normally slidable along the shaft 32 between the intermediate ledge 148 and the leading or top edge of the shank 162 when the T-handle 80 is elevated into an operational position. The barrier 166 thereby functions as a stop to limit the normally sliding position of the shaft 32 and T-handle 80.

A handle attachment collar 170 may then be used to prevent separation of the shaft 32 and T-handle 80 from the shaft guide bracket 164. The handle attachment collar 170 is preferably cylindrical in shape having a rear wall 172, a normally extending handle shank slot 174, a pair of interior prong receiving channels 176, and a pair of outwardly extending affixation tabs 178.

The normally extending handle shank slot 174 is preferably sized to slidably receive and cover the shank 162 of the T-handle 80 irrespective of the location of the T-handle 80 within a normal operational position or a traverse non-operational position relative to the tray 12. The barrier 166 is preferably sized for positioning within the normally extending handle shank slot 174.

The pair of interior prong receiving channels 176 are preferably constructed and arranged to each receive an attachment prong 150 which prevents radial rotation of the shaft 32 relative to either the shaft guide bracket 164 or the handle attachment collar 170. In addition, positioning of the barrier 166 within the normally extending handle shank slot 174 also prevents radial rotation of the shaft 32 relative to either the shaft guide bracket 164 and/or the handle attachment collar 170.

Each of the pair of outwardly extending affixation tabs 178 are constructed and arranged for positioning within one of the guide slots 168 of the shaft guide bracket 164.

During assembly, the handle attachment collar 170 is preferably lowered over the shank 162 of the T-handle 80 for insertion of the shank 162 into the normally extending handle shank slot 174. Alignment between the prongs 150 and the prong receiving channels 176 may thereby occur. The handle attachment collar 170 is then manipulated towards the shaft guide bracket 164 for insertion of the prongs 150 into the prong receiving channels 176 and further insertion of the affixation tabs 178 into the opposite guide slots 168 to secure the handle attachment collar 170 to the shaft guide bracket 164. The shank 162 of the T-handle 80 may alternatively have affixation prongs 88.

The shank 162 preferably includes a roller 180 which is located adjacent to a top or leading edge opposite to the pivot pin 160. The roller 180 preferably engages the bearing surface of the barrier 166 within the normally extending handle shank slot 174 during elevation and/or descent of the T-handle 80 into or from an operational position. The handle spring 182 as positioned in surrounding relationship over the longitudinally extending square section 144 and cylindrical section 146 of the shaft 32 may thereby be expanded. Alternatively, tension may be placed on the handle spring 182 when the T-handle 80 is lowered from a normal operational position to an at rest locking position. The handle spring 182 is preferably positioned between a position limiter 192 and the spring channel 184 within the interior of the collar 186 as positioned over the distal end 188 of the shaft cylinder casing 29. The handle spring 182 preferably engages the surface of the position limiter 192 opposite to the shaft guide bracket 164.

Centrally within the shaft cylinder casing 29 is located the shaft bore 190. The shaft bore 190 is preferably constructed to receive through a pressure fit the shaft 32, the shaft guide bracket 164, and the handle attachment collar 170. At least the longitudinally extending square section 144 of the shaft 32 extends rearwardly beyond the shaft bore 190 and shaft cylinder casing 29. The rearward surface of the shaft guide bracket 164 is preferably adjacent to the position limiter 192 which is integral within the interior of shaft cylinder casing 29 and is centrally positioned in the shaft bore 190. The position limiter 192 includes a central opening for normal passage of the shaft 32. The position limiter 192 prevents undesirable penetration of the shaft 32, T-handle 80, shaft guide bracket 164, and/or the handle attachment collar 170 rearwardly within the shaft bore 190. Following insertion of the shaft 32, shaft guide bracket 164, and handle attachment collar 170 into the shaft bore 190, a portion of the cylindrical section 146 and the longitudinally extending square section 144 of the shaft 32 will rearwardly pass the position limiter 192 defining a second spring receiving channel 194 which, in turn, is defined as an area between the cylinder section 146, the position limiter 192, and the interior wall of the shaft cylinder casing 29.

The exterior of the shaft cylinder casing 29 includes a first protruding section 122, a pair of intermediate sections 196, and a second notch 246. The first protruding section 122 defines a first positioning limiter or rotation restriction surface 124 and a second positioning limiter or rotation restriction surface 126.

The collar 186 is generally cylindrical. The collar 186 includes a rear wall 200 having a substantially square lug 202 having a central opening therethrough. The lug 202 is constructed for insertion into a substantially square opening in an L-shaped, cam base 204. Opposite to the rear wall 200 is located a second protruding section 242, a pair of second intermediate sections 244, and a first notch 198. Within the interior of the collar 186, is a centrally positioned sleeve 248 having a substantially square opening 250 therethrough. The square opening 250 is preferably adapted for slidable receiving engagement of the square section 144 of the shaft 32. The spring channel 184 is defined between the sleeve 248 and the interior wall of the collar 186. The second protruding section or notch 242 defines a third rotational restriction surface 252, and a fourth rotational restriction surface 254.

The substantially square lug 202 is preferably constructed to prevent rotation of the L-shaped cam base 240 relative to the collar 186. The screw 156 passes through a washer 256 for threaded penetration into the threaded aperture 154 of the longitudinally extending square section 144 of the shaft 32. The engagement of the screw 156 to the threaded aperture 154 securely couples the L-shaped cam base 240, collar 186, handle spring 182, shaft cylinder casing 29, shaft 32, shaft guide bracket 164, handle attachment collar 170, and T-handle 80 together.

The collar 186 is constructed for mating coupling to the distal end 188 of the shaft cylinder casing 29. The protruding section 122 of the shaft cylinder casing 29 is constructed for insertion into the first notch 198 of the collar 186 when the T-handle 80 is placed into a downward nested non-operational position relative to the tray 12. The protruding section 122 is likewise constructed for separation and/or retraction from the first notch 198 upon release of tension from the handle spring 182 upon the elevation of the T-handle 80 from the nested position to the operational normal position relative to the tray 12. In addition, the second protruding section 242 of the collar 186 is constructed for insertion and coupling to the second notch 246 of the shaft cylinder casing 29 simultaneously to the coupling of the first notch 198 of the collar 186 to the first protruding section 122. Furthermore, the coupling of the collar 186 to the distal end 188 of the shaft cylinder casing 29 positions the pair of intermediate sections 196 proximate to the second intermediate sections 244. The positioning of the T-handle 80 downwardly into the nested non-operational position relative to the tray 12 couples the collar 186 to the shaft cylinder casing 29. In this non-operational position the handle spring 182 is compressed. The uncoupling and/or release of the collar 186 from the shaft cylinder casing 29 during elevation of the T-handle 80 upwardly from the tray 12 to the normal aligned operational position relative to the shaft 32 separates the collar 186 from the shaft cylinder casing 29 by expansion of the handle spring 182. Radial rotation of the T-handle 80 in either a clockwise direction or a counterclockwise direction will cause the radial rotation of the collar 186 relative to the shaft cylinder casing 29. The clockwise radial rotation of the shaft 32 causes the third rotational restriction surface 252 to rotate upwardly to a position proximate to the first rotational restriction surface 124. Clockwise radial rotation of the shaft 32 is prohibited upon contact between the third rotational restriction surface 252 and the first rotational restriction surface 124. Conversely, the counterclockwise radial rotation of the shaft 32 causes the fourth rotational restriction surface 254 to rotate upwardly to a position proximate to the second rotational restriction surface 126. Further counterclockwise radial rotation of the shaft 32 is prohibited upon contact between the fourth rotational restriction surface 254 and the second rotational restriction surface 126.

Rotation of either the third rotational restriction surface 252 toward the first rotational restriction surface 124, or the fourth rotational restriction surface 254 toward the second rotational restriction surface 126 causes the downward rotation of the L-shaped cam base 240 releasing a roller cam 258 from a keeper (not shown). The roller cam 258 is preferably rotatably affixed to the L-shaped cam base 240 through the use of a cam pin 260. The roller cam 258 is preferably rotatably affixed to the L-shaped cam base 240 upon a roller support section 262.

The latching of the roller cam 258 to a keeper may occur by the opposite radial rotational of the third rotational restriction surface 252 from the first rotational restriction surface 124 or the fourth rotational restriction surface 254 from the second rotational restriction surface 126 by manipulation of the T-handle 80 in a reverse counterclockwise or clockwise direction. Engagement between the roller cam 258 and a keeper will normally occur upon alignment of the protruding section 122 to the first notch 198 and the alignment of the second protruding section 242 to the second notch 246. Alignment between the first and second protruding sections 122, 242 to the respective first and second notches 198, 246 occurs upon the return of the T-handle 80 to the initial normal operational position relative to the shaft cylinder casing 29 and/or tray 12.

During unlocking the rotation of the key 106 causes the radial rotation of the locking cylinder 26 causing the cam pin 140 to place downward force against the cam pin slot 136 to downwardly alter the position of the pin bracket 130 relative to the back plate cover 120 for withdrawal of the pin 40 from the pin aperture 92 of the T-handle 80.

The removal of the padlock 84 from the padlock hasp 128 and first recessed padlock receiving depression 48 may then occur which in turn will cause the hasp spring 104 to expand to retract the prongs or arms of the padlock hasp 128 rearwardly into the padlock slots 54 toward the backside 14 of the tray 12. The removal of the padlock 84 from the padlock hasp 128 may occur before radial rotation of the lock cylinder 26 is initiated. The at rest position for the padlock hasp 128 is to be partially withdrawn into the tray 12 and back plate cover 120. To utilize a padlock 84 as a secondary locking mechanism, an individual is required to grasp the padlock hasp 128 for forward and outward manipulation relative to the tray 12, thereby compressing the hasp spring 104. An opened padlock 84 may then be inserted through the padlock receiving apertures 118 and over the padlock receiving region 82 of the T-handle 80 whereupon the padlock 84 may be re-locked.

The elevation of the T-handle 80 from the non-operational nesting position relative to the tray 12 separates the padlock receiving region 82 from the second recesses handle receiving region 50. The elevation of the T-handle 80 further causes the downward contact and positioning of the roller 180 of the shank 162 along the bearing surface of the barrier 166 until normal operational positioning of the T-handle 80 relative to the shaft 32 and shaft cylinder casing 29 has occurred. The expansion of the handle spring 182 is thereby permitted separating the collar 186 from the shaft cylinder casing 29 and the retraction of the second protruding section 242 from the second notch 246 and the retraction of the first protruding section 122 from the first notch 198.

The T-handle 80 may then be radially rotated in either a clockwise or counterclockwise direction for transfer of motion through the shaft 32 to the L-shaped cam base 240 for downward separation of the roller cam 258 from a keeper in either a clockwise and/or counterclockwise direction. Opening of a door may then occur.

The steps for unlocking of the padlock 84, retraction of the pin 40 from the pin aperture 92, and rotation of the T-handle 80 for disengagement of the roller cam 258 from the keeper as described herein may be reversed for latching of a door and securing of the door to a keeper through the use of the double locking mechanism of the T-handle 80.

The rear surface of the second recessed handle receiving region 50 defines a bridge position between the padlock slots 54 of the tray 12. The base of the second recessed handle receiving region 50 also has an opening for passage of the pin 40 for engagement to the pin aperture 92 of the T-handle 80.

The breakaway features of the fracturable throat section 94 of the T-handle 80 deter the opening and failure of the handle without prior manipulation of the lock cylinder 26.

An alternative embodiment of the shaft casing 60 or collar 186 is depicted in FIGS. 10 through 17. In this embodiment, the shaft casing 60 and/or collar 186 includes a first angled ramp 300 and a second angled ramp 302. The first angled ramp 300 and second angled ramp 302 facilitate rotation of the T-handle 80 during adverse weather and/or environmental conditions. The first position limiter 124 is preferably proximate and adapted to slide along the first ramp 300 during rotation of the T-handle in a clockwise direction. The second position limiter 126 is positioned proximate and is adapted to slide along the second ramp 302 during counterclockwise rotation of the T-handle 80. In the closed non-operational position the first protruding section 122 is fully inserted into, and is in contact with, the back or end surface of the first notch 198.

Figure 10:
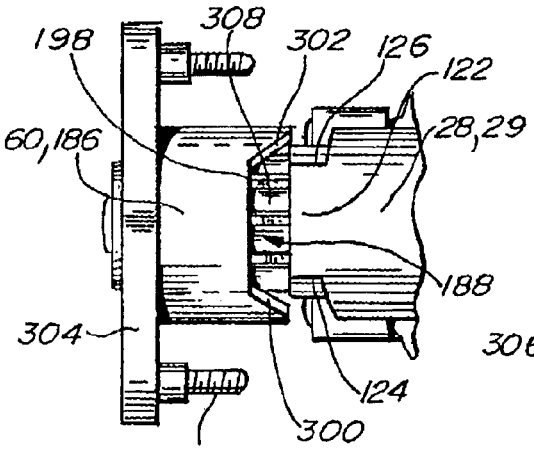
FIG. 10 is a top detail view of an alternative embodiment of the collar and/or shaft casing.
Figure 11:
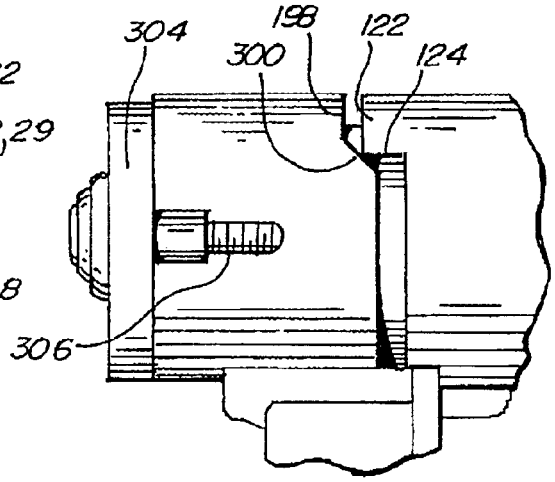
FIG. 11 is a side detail view of an alternative embodiment of the collar and/or shaft casing as depicted in FIG. 10.

As depicted in FIG. 10, an alternative latch bar 304 replaces the L-shaped cam base 240 and roller cam 258. The latch bar 304 may include one or more affixation members 306 for engagement to mating keepers and/or to a structure such as door.

Figure 15:
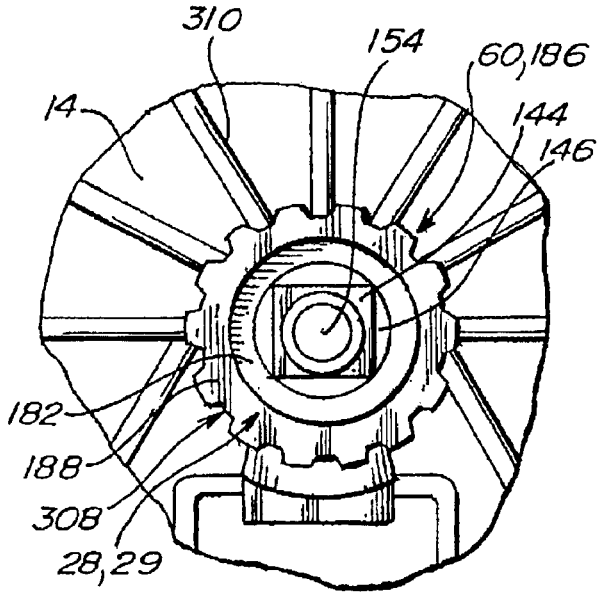
FIG. 15 is a detail end view of an alternative shaft cylinder casing including recess channels.

Referring to FIGS. 10 and 15, the shaft cylinder casing 28, 29 is adapted for insertion into the shaft casing 60 or collar 186. The shaft cylinder casing 28, 29 includes a distal end 188 which is preferably elongate and includes a plurality of longitudinally extending channels 308.

In general, a contact surface occurs between the interior of the shaft casing 60 and/or collar 186 and the exterior surface of the distal end 188 of the shaft cylinder casing 28, 29. In adverse moisture and temperature conditions, moisture may potentially freeze rendering rotation of the T-handle difficult do to binding between the shaft cylinder casing 28, 29 and the shaft casing 60 or collar 186. The longitudinally extending channels 308 reduce the surface contact area between the interior surface of the cylinder casing 60 and/or collar 186 and the shaft cylinder casing 28, 29.

The longitudinally extending channels 308 are preferably regularly spaced and substantially parallel to each other and positioned normally about the circumference of the distal end 188 of the shaft cylinder casing 28, 29.

As may be seen in FIG. 15, the backside 14 of the tray 12 preferably includes a plurality of support ribs 310.

Figure 12:
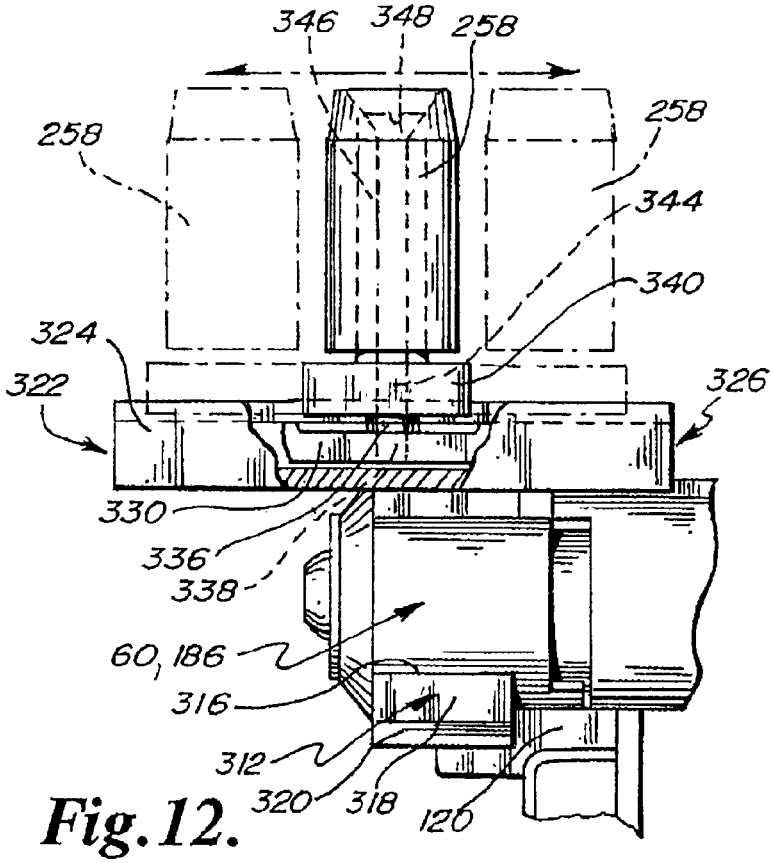
FIG. 12 is an alternative detail side view of a collar having a rotational handle restricter and an adjustable cam.
Figure 13:
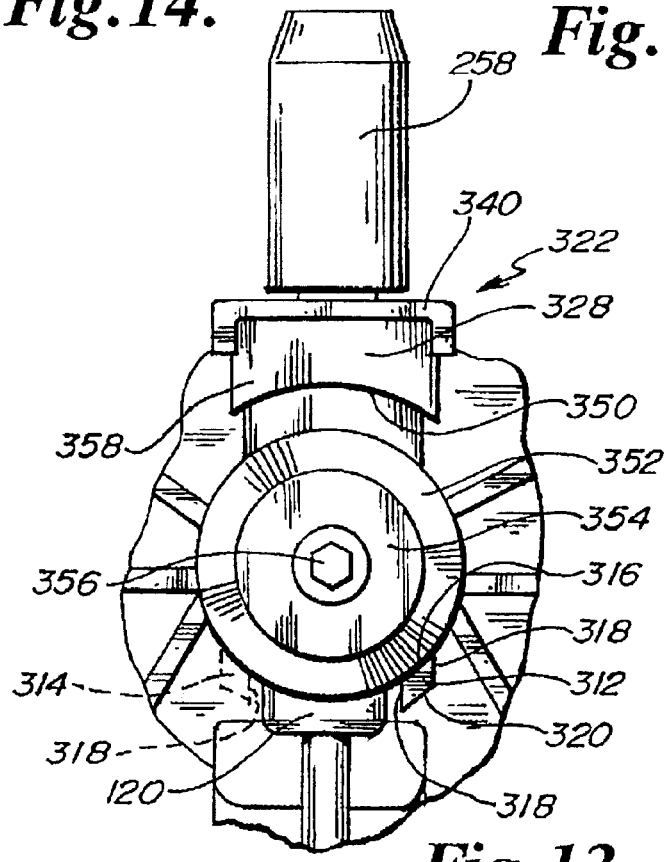
FIG. 13 is an alternative detail rear view of a collar having a rotational handle restricter and an adjustable cam.

Referring to FIGS. 12 and 13, the cylinder casing 60 and/or collar 186 may include either a first handle rotational stop 312 or a second handle rotational stop 314. The first handle rotational stop 312 permits the T-handle 80 to be rotated in a clockwise direction only. The second rotational handle stop 314 permits counterclockwise rotation of the T-handle 80 only.

Each of the first rotational handle stop 312 and second rotational handle stop 314 includes a curved affixation surface 316 for being integral and/or permanently affixed to the exterior surface of the shaft casing 60 and/or collar 186. The first rotational handle stop 312 and second rotational handle stop 314 also include a pair of parallel sidewalls 318 and a substantially straight transition wall 320. Each of the pair of parallel sidewalls 318 are preferably of the same length dimension and therefore the transition wall 320 is angled to facilitate rotation of the shaft casing 60 and/or collar 186.

The first rotational handle stop 312 preferably prevents counterclockwise rotation of the T-handle 80 when elevated into an operational position. Counterclockwise rotation of the T-handle 80 is not permitted due to contact between the sidewall 318 and the top portion of the back plate cover 120.

The second rotational handle stop 314 preferably prevents clockwise rotation of the T-handle 80 when elevated into an operational position. Clockwise rotation of the T-handle 80 is not permitted due to contact between the sidewall 318 and the top portion of the back plate cover 120.

Figure 14:
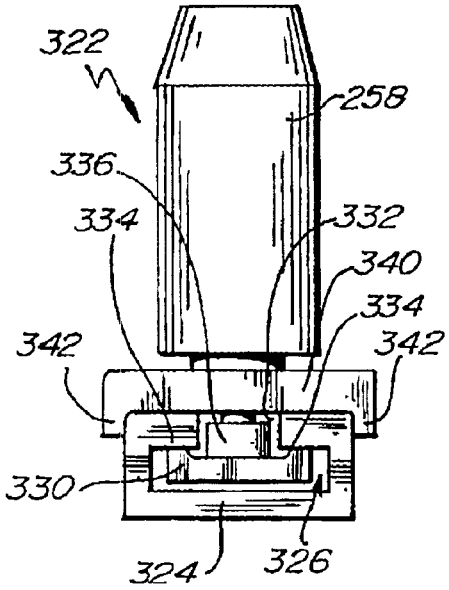
FIG. 14 is a detail end view of an adjustable cam.

As depicted in FIGS. 12, 13, and 14, an adjustable cam support is identified in general by the reference numeral 322 which is integral to the shaft casing 60 and/or collar 186.

The adjustable cam support 322 preferably includes substantially rectangular tubular bracket 324 having an open end 326 proximate to the backside 14 of the face plate 12 and a closed end 328.

The substantially rectangular tubular bracket 324 preferably includes a cam slot 332 which in turn defines a pair of opposite parallel retaining ledges 334.

Within the interior of the substantially rectangular tubular bracket 324 is preferably located a slide 330 having an upwardly extending guide 336 which is preferably positioned within the cam slot 332. Centrally positioned within the slide 330 is preferably located a threaded receiving aperture 338.

A platform 340 having an opposite pair of positioning tabs 342 is preferably slidably engaged to the top surface of the substantially rectangular tubular bracket 324. The positioning tabs 342 are preferably adapted for contact with the exterior edges of the substantially rectangular tubular bracket 324. The platform 340 preferably includes a centrally located threaded aperture 344. Vertically above the platform is preferably located a roller cam 258 which includes a central aperture 346 for receiving engagement of a fastener 348 such as a bolt. The fastener 348 is preferably elongate passing through the central aperture 346 of the roller cam 258, through the threaded aperture 344 of the platform 340, through the guide 336 and threaded receiving aperture 338 and into the slide 330.

Rotation of the fastener 348 in a tightening direction preferably causes the slide 330 to elevate for compression and friction between the slide 330 and the platform 340 to cause downward force on the opposite pair of retaining ledges 334 to securely position the roller cam 258 in a desired location relative to the adjustable cam support 322. The roller cam 258 is preferably freely rotatable about the fastener 348 following tightening of the fastener 248 relative to the slide 330, platform 340 and/or rectangular tubular bracket 324.

The portion of the rectangular tubular bracket proximate to the open end 326 preferably has an arcuate surface 350 to substantially conform to the exterior shape of the shaft cylinder casing 28, 29 to permit free rotation therebetween.

The rotation of the fastener 348 into a unengaged position releases the compression between the platform 340, slide 330, and/or opposite pair of retaining ledges 334 of the rectangular tubular bracket 324 to permit slidable positioning of the adjustable cam support 322. The positioning tabs 342 located to the exterior of the upper surface of the rectangular tubular bracket 324 preferably enable slidable positioning of the platform 340 relative to the rectangular tubular bracket 324. The closed end 328 prohibits disengagement of the slide 330 from the interior of the rectangular tubular bracket 324. In addition, the positioning of the open end 326 as proximate to the rear surface 14 of the tray 12 further prevents the disengagement of the slide 330 from the interior of the rectangular tubular bracket 324. During positioning of the roller cam 258 relative to the adjustable cam support 322, the guide 336 and the fastener 348 will traverse and freely pass through the cam slot 332.

The adjustable cam support 332 enables positioning of the roller cam 258 at any desired location for engagement to a keeper not shown.

Referring to FIG. 13, the shaft casing 60 and/or collar 186 includes a beveled surface 352, washer 354, and bolt 356. Upwardly from the beveled surface 352 is a transition surface 358 which is integral to both the cylinder casing 60 and/or collar 186 and the adjustable cam support 322.

Figure 16:
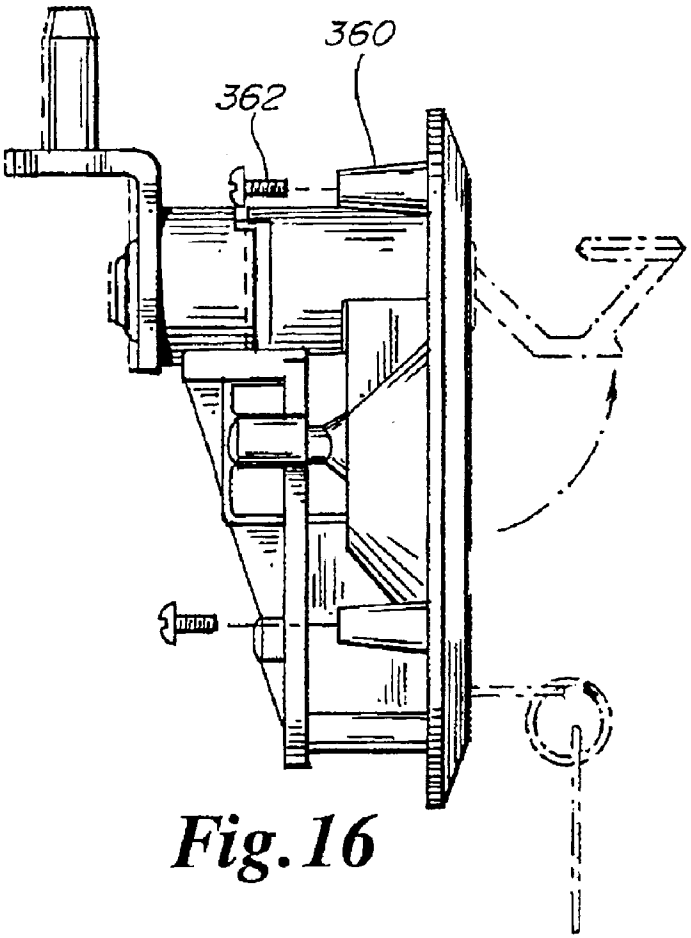
FIG. 16 is a detail side view of an alternative face plate including integral studs.
Figure 17:
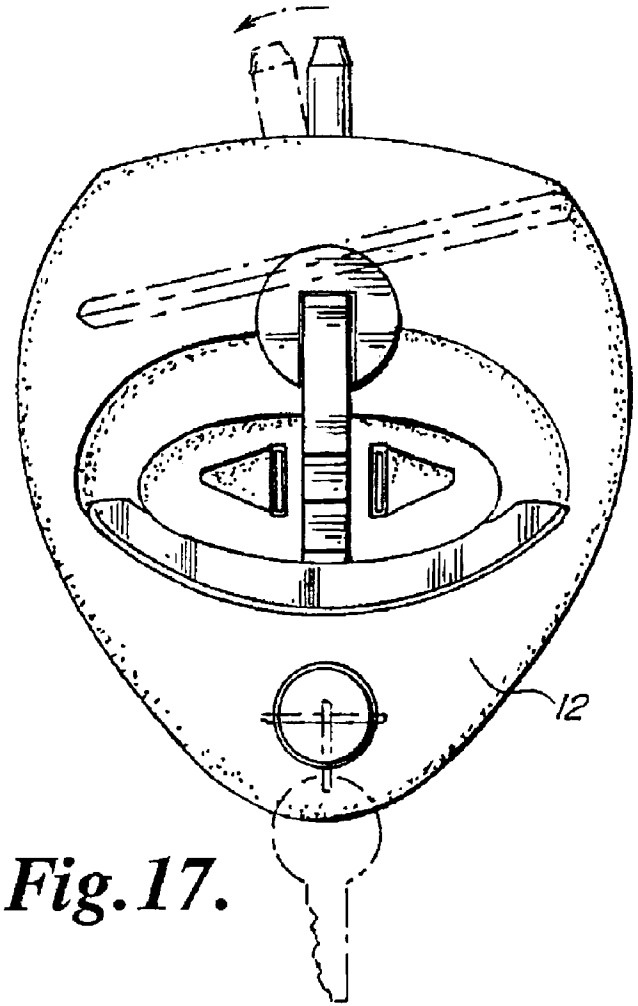
FIG. 17 is an alternative front view of a face plate.

Referring to FIGS. 16 and 17, an alternative face plate 12 is illustrated. The face plate 12 of FIGS. 16 and 17 omit the affixation apertures 20 whereupon the face plate 12 is an integral one piece unit. The rear 14 of the face plate 12 may include permanently affixed threaded studs 360 which may be utilized for affixation to a structure such as a door. Alternatively, the studs 360 may be substituted for integral receiving mounts 360 which are adapted to receive fasteners 362 to secure the rear 14 of the face plate to a structure such as a door.

In an alternative embodiment, the padlock hasp 128 may be omitted whereupon the pair of padlock hasp receiving slots 54 may be blocked by use of a plug which may be formed of plastic. The pair of padlock hasp receiving slots may be plugged from the rear 14 of the face plate 12 prior to the attachment of the back plate cover 120. In addition, the lock cylinder 26 may be omitted. The lock cylinder 26 may be replaced with a plastic plug which may be generally inserted within the lock cylinder casing 22 from the rear face 14 prior to the affixation of the back plate cover 120. The face plate or tray 12 may be formed of vinyl or injected molded plastic, may be stamped, may be die cast, and/or formed of stainless steel material for use in hostile or corrosive environments.

This completes the description of the preferred and alternate embodiments of the invention. Those skilled in the art may recognize other equivalents to the specific embodiment described herein which equivalents are intended to be encompassed by the claims attached hereto.

The above examples and disclosure are intended to be illustrative and not exhaustive. These examples and description will suggest many variations and alternatives to one of ordinary skill in the art. All of these alternatives and variations are intended to be included within the scope of the attached claims. Those familiar with the art may recognize other equivalents to the specific embodiments described herein which equivalents are also intended to be encompassed by the claims attached hereto.

The present invention may be embodied in other specific forms without departing from the spirit or essential attributes thereof; therefore, the illustrative embodiments should be considered in all respects as illustrative and not restrictive, reference being made to dependent claims rather than to the foregoing description to indicate the scope of the invention.

While this invention may be embodied in many different forms, there are described in detail herein specific preferred embodiments of the invention. This description is an exemplification of the principles of the invention and is not intended to limit the invention to the particular embodiments illustrated.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below (e.g. claim 3 may be taken as alternatively dependent from claim 2; claim 4 may be taken as alternatively dependent on claim 2, or on claim 3; claim 6 may be taken as alternatively dependent from claim 5; etc.).

What is claimed is:

1. A double locking T-handle assembly comprising:

a) a tray, said tray having a front side a back side and at least one hasp slot, said back side having a lock cylinder casing, and a shaft cylinder casing, said front side having a handle receiving area;

b) a latching assembly comprising a shaft positioned within said shalt cylinder casing, a bracket attached to said shaft, and a roller cam attached to said bracket;

c) a padlock hasp engaged to said tray, said padlock hasp being constructed and arranged for receipt of a padlock;

d) a lock cylinder positioned within said lock cylinder casing; and e) a handle comprising a fracturable throat section, said handle being pivotally connected to said shaft, said handle having a pair of grasping members said handle being constructed for positioning within said tray, said handle being further adapted for positioning proximate to said padlock hasp.

2. The double lock T-handle assembly according to claim 1, said tray further comprising a recessed handle receiving region.

3. The double lock T-handle assembly according to claim 2, said handle further casing comprising a padlock receiving region.

4. The double lock T-handle assembly according to claim 3, said shaft cylinder casing comprising at least one rotational restriction surface.

5. The double lock T-handle assembly according to claim 4, said latch assembly further comprising a handle shank engaged to said handle, a handle attachment collar having a slot positioned over said handle shank, a shaft guide bracket having a barrier engaged to said handle attachment collar, said shaft having at least one engagement prong disposed through said handle attachment collar and said shaft guide bracket for pivotal affixation to said handle shank.

6. The double lock T-handle assembly according to claim 4, said shaft cylinder casing further comprising a positioning limiter.

7. The double lock T-handle assembly according to claim 4, further comprising a collar having a lug and a sleeve.

8. The double lock T-handle assembly according to claim 6, said latch assembly further comprising a handle spring positioned around said shaft between said collar and said positioning limiter.

9. The double lock T-handle assembly according to claim 8, further comprising a second spring engaged to said padlock hasp and to said back side of said tray, said second spring being constructed and arranged to retract said padlock hasp within said tray.

10. The double lock T-handle assembly according to claim 4, said tray further comprising a pin aperture constructed and arranged to permit passing of a pin, said pin being engaged to said lock cylinder, said lock cylinder being constructed to cause elevation or retraction of said pin within said pin aperture.

11. The double lock T-handle assembly according to claim 4, said tray further comprising a back plate cover constructed and arranged for covering of said padlock hasp, and said lock cylinder casing.

12. The double lock T-handle assembly according to claim 10, further comprising a pin bracket comprising a guide slot, a cam slot, a pin support, said pin extending outwardly from said pin bracket.

13. The double lock T-handle assembly according to claim 12, said cam having a cam pin constructed and arranged for positioning in said cam slot.

14. The double lock T-handle assembly according to claim 13, said tray further comprising a guide, said guide constructed and arranged for positioning within said guide slot.

15. The double lock T-handle assembly according to claim 5, said handle attachment collar further comprising at least one internal prong receiving slot.

16. The double lack T-handle according to claim 1, further comprising a shaft casing having a first notch having a pair of angled ramps.

17. The double lock T-handle according to claim 1, said shaft cylinder casing further comprising a distal end having a plurality of channels.

18. The double lock T-handle according to claim 16, said shaft casing comprising a handle rotation stop.

19. The double lock T-handle according to claim 1, wherein said bracket is a substantially tubular bracket, said latching mechanism comprising a slide, a cam slot, and a platform wherein said roller cam is adjustably positionable relative to said bracket.

20. A double locking T-handle assembly comprising:

a) a tray, said tray having a front side, a back side and at least one hasp slot, said back side having a lock cylinder casing, and a shaft cylinder casing, said front side having a handle receiving area;

b) a latching assembly comprising a shaft positioned within said shaft cylinder casing, a bracket attached to said shaft, and a roller cam attached to said bracket;

c) a handle, said handle being pivotally connected to said shaft, said handle having a pair of grasping members and a central member, said handle being constructed for positioning within said tray;

d) a lock cylinder positioned within said lock cylinder casing; and e) a padlock hasp engaged to said tray, said padlock hasp being constructed and arranged for traversing said tray, said padlock hasp being further constructed and arranged for receipt of a padlock, said padlock being positioned forward of and adjacent to said central member.

* * * * *